US008182200B2

(12) United States Patent
Cox

(10) Patent No.: US 8,182,200 B2
(45) Date of Patent: May 22, 2012

(54) SELF PRIMING PUMP

(75) Inventor: Stephen Cox, Coventry (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 1271 days.

(21) Appl. No.: 11/904,974

(22) Filed: Sep. 28, 2007

(65) Prior Publication Data

US 2008/0089778 A1 Apr. 17, 2008

(30) Foreign Application Priority Data

Oct. 12, 2006 (GB) ..... 0620277.4

(51) Int. Cl.
*F04D 9/02* (2006.01)
*F04D 29/66* (2006.01)

(52) U.S. Cl. ..... 415/56.1

(58) Field of Classification Search ..... 415/56.1; 417/199.2, 204

See application file for complete search history.

(56) References Cited

U.S. PATENT DOCUMENTS

| | | | | |
|---|---|---|---|---|
| 2,412,839 | A | 3/1944 | Smith | |
| 2,472,802 | A | 6/1947 | Bentley | |
| 3,578,880 | A | 5/1971 | Cygnor | |
| 4,035,104 | A | 7/1977 | Buse | |
| 4,392,791 | A * | 7/1983 | Mandroian | 417/379 |
| 7,037,086 | B2 * | 5/2006 | Irvine | 417/199.2 |

FOREIGN PATENT DOCUMENTS

| | | | |
|---|---|---|---|
| DE | 69200755 | T2 | 5/1995 |
| EP | 1 505 301 | A2 | 9/2005 |
| GB | 804265 | A | 11/1958 |

* cited by examiner

*Primary Examiner* — Edward Look
*Assistant Examiner* — Sean J Younger
(74) *Attorney, Agent, or Firm* — Peter Van Winkle

(57) ABSTRACT

A self-priming centrifugal pump comprises a centrifugal impeller (19) arranged in a pumping chamber (9) for transferring liquid from an inlet (5) to an outlet (7) of the chamber, a diaphragm (21) arranged downstream of the impeller for providing priming, and a drive means (25) for driving the diaphragm with reciprocating motion during priming. The diaphragm and the drive means are arranged so that a pressure increase downstream of the impeller after priming causes a change in the neutral position of the diaphragm, which then causes disengagement of the drive means. The drive means may comprises a cam and cam follower arrangement or a crank and connecting arm arrangement.

4 Claims, 5 Drawing Sheets

SELF PRIMING PUMP

CROSS-REFERENCE

Applicant claims priority from British patent application GB 0620277.4 filed 12 Oct. 2006.

BACKGROUND OF THE INVENTION

The present invention relates to a centrifugal pump. More particularly, the present invention relates to a self-priming centrifugal pump.

A centrifugal pump works by increasing the pressure of a fluid using a rotating impeller. Typically, a liquid enters the pump at or near an axis of rotation and is accelerated by the impeller. The liquid then flows radially outwards into downstream piping.

A centrifugal pump is not self-priming, and various mechanisms for providing self-priming centrifugal pumps have been developed.

Most commonly, a self-priming centrifugal pump is provided with a discharge tank contained in the pump housing and connected to recirculate liquid through the pumping chamber for priming. These tanks are initially provided with a supply of the liquid to be pumped and, during priming, the pump impeller is rotatably driven to recirculate liquid from the tank through the pumping chamber, so that gas in the pumping chamber becomes entrained with the recirculated liquid.

In other designs, an additional external pump is provided solely for priming. For example, a liquid piston pump, functioning as a priming wheel, may be provided for this purpose.

EP 1505301 discloses a further self-priming centrifugal pump design. In this design, a diaphragm is provided in the liquid flow path and driven with reciprocating motion to provide the priming. After the pump has been primed, the diaphragm may be disengaged using a clutch.

There is a continuing need for a compact, efficient and effective self-priming centrifugal pump design.

SUMMARY OF THE INVENTION

According to the invention, there is provided a self-priming centrifugal pump comprising a centrifugal impeller arranged in a pumping chamber for transferring liquid from an inlet to an outlet of the chamber, a diaphragm arranged downstream of the impeller for providing priming, and a drive means for driving the diaphragm with reciprocating motion during priming. The diaphragm and the drive means are arranged so that a pressure increase downstream of the impeller after priming causes a change in the neutral position of the diaphragm and consequent disengagement of the drive means.

The drive means drives the diaphragm with reciprocating motion to provide a pumping function suitable for priming. After the pump has been primed, the impeller is able to provide the pumping function, thereby causing a downstream increase in pressure. This increase in pressure is used to trigger a disengagement of the drive means from the diaphragm, thereby conserving energy.

For the avoidance of doubt, the phrase "neutral position of the diaphragm" in the context of the invention means the position of the diaphragm if it were not being driven with reciprocating motion by the driving means.

The diaphragm and drive means can be integrated into a centrifugal pump without taking up significant additional space.

The pump may further comprise one-way valves upstream and downstream of the diaphragm. The valves ensure that the pumping function provided by the diaphragm for priming is effective, by ensuring that the liquid can only flow in one direction through the pump.

The pump may further comprise a motor having an output shaft for driving the impeller. The output shaft of the motor may also drive the diaphragm via the drive means. In the latter case, the output shaft of the motor may comprise first and second shaft members for rotating the impeller with a first angular speed and for driving the diaphragm via the drive means with a second angular speed, respectively. The second angular speed may be lower than the first angular speed. The first and second shaft members may be concentric about a common axis.

The diaphragm may be arranged in a separate priming chamber provided downstream of the pumping chamber. The inlet and outlet of the priming chamber may be defined by the one-way valves.

The diaphragm defines a part of the surface of the liquid flow path, such that the reciprocating motion of the diaphragm causes a volume of the liquid flow path to periodically expand and contract. In this way, the pumping function is provided for priming the pump.

The drive means may comprise a means for converting rotational motion into the reciprocating motion for driving the diaphragm. In one arrangement, the means for converting comprises a cam and a cam follower. The cam and the cam follower are arranged to lose contact when the pressure increase downstream of the impeller after priming causes the change in the neutral position of the diaphragm, thereby disengaging the drive means.

The drive means may further comprise a resilient element against which the diaphragm is driven with the reciprocating movement. The resilient element may be a tension spring provided on the liquid flow path side of the diaphragm or a compression spring provided on the side opposite the liquid flow path side of the diaphragm.

In an alternative arrangement, the means for converting comprises a crank and a connecting arm, the connecting arm being arranged to couple the crank to the diaphragm. The crank and the connecting arm are arranged so that they disengage when the pressure increase downstream of the impeller after priming causes the change in the neutral position of the diaphragm, thereby disengaging the drive means.

The drive means may further comprise a resilient element arranged to maintain the engagement of the crank and the connecting arm until a change in the neutral position of the diaphragm restricts the motion of the connecting arm, thereby causing the disengagement. The drive means may also comprise a fixed surface for restricting the motion of the connecting arm when the neutral position of the diaphragm.

The pump may comprise a single diaphragm, or a plurality of diaphragms may be mounted in a circular carrier, with the diaphragms being provided in a circle around the central axis of the carrier. In the latter case, the drive means is arranged to drive each of the diaphragms with reciprocating motion during priming.

Embodiments of the invention will now be described in detail, by way of example only, with reference to the accompanying drawings.

DESCRIPTION OF THE INVENTION

The invention provides a self-priming centrifugal pump in which a diaphragm is arranged downstream of the centrifugal impeller for providing priming. A drive means drives the diaphragm with reciprocating motion during priming. After priming, the impeller provides the pumping function, thereby causing a downstream increase in pressure. This pressure change causes a corresponding change in the neutral position of the diaphragm, which results in disengagement of the drive means from the diaphragm.

Figure 1:
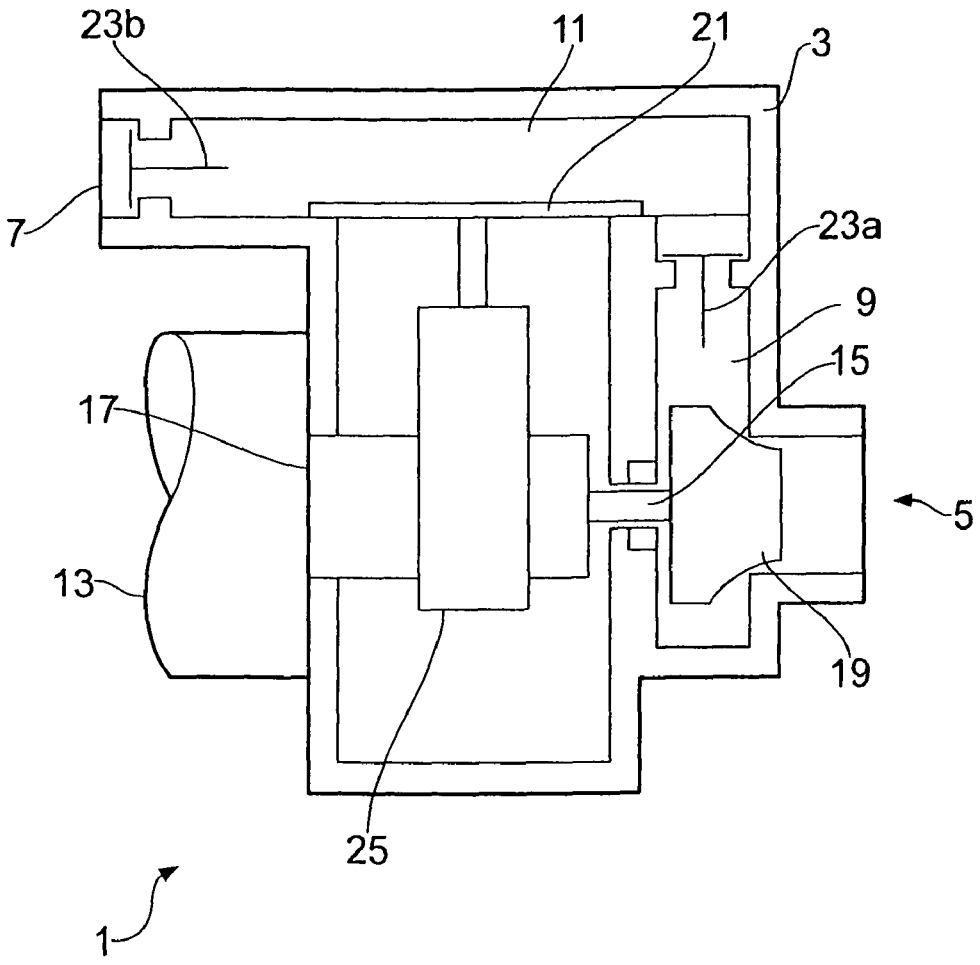
FIG. 1 is a schematic view of a self-priming centrifugal pump according to the invention.

FIG. 1 shows schematically a first embodiment of a pump 1 according to the invention. The pump 1 has a body 3 which defines a liquid inlet 5 and a liquid outlet 7. A liquid flow path or cavity is defined between the inlet 5 and the outlet 7, which includes an upstream pumping chamber 9 and a downstream priming chamber 11. The priming chamber 11 is arranged downstream of the pumping chamber 9.

The pump 1 also includes a motor 13 which is mounted to the pump body 3. The motor 13 is mounted using threaded bolts (not shown), so that it can be removed for replacement and/or maintenance. The motor 13 has a pair of concentric output shafts 15, 17. A first, inner, one of the output shafts 15 is arranged to rotate at a first angular speed and a second, outer, one of the output shafts 17 is arranged to rotate at a second, lower, angular speed. The differential angular speeds of the output shafts 15, 17 are provided by a gearing mechanism (not shown) which forms part of the motor 13. Suitable mechanisms for the gearing mechanism will be known to those skilled in the art.

The first, inner, drive shaft 15 drives a centrifugal impeller 19 which is rotatably mounted in the pumping chamber 9. The impeller 19 is arranged to receive a liquid at or near its axis of rotation. Rotation of the impeller 19 causes an acceleration of the liquid due to a centrifugal force, and the liquid is delivered at or near the periphery of the impeller 19. The acceleration of the liquid causes an increase in pressure downstream of the impeller 19, and this provides the basic liquid pumping functionality. A suitable shape for the impeller 19 is not shown in the Figure, but will be known to those skilled in the art.

As will be appreciated, the pump 1 is intended for use with liquids. As such, the impeller 19 forms a seal with the body 3 that is capable of preventing the passage of liquid, so that the pumping operation is performed in an effective manner. The seal is not, however, capable of preventing the passage of gas, including air. Thus, before the pump 1 can be used, it is necessary to eliminate any air that may be present in the flow path of the pump 1. This process is known as priming.

For the priming function, the pump 1 shown in FIG. 1 is provided with a deformable circular diaphragm 21. The diaphragm 21 forms a part of the surface of the priming chamber 11 which, as mentioned above, is provided in the flow path downstream of the pumping chamber 9. The pump 1 is also provided with one-way valves 23*a*, 23*b* arranged at the inlet and exit of the priming chamber 11, and a drive means 25 coupled to the second, outer, shaft 17 of the motor 13 for driving the diaphragm 21 with reciprocating motion.

The diaphragm 21 is gas and liquid tight, and is gas and liquid sealed to the body 3 about its periphery. Deformation of the diaphragm 21 causes a small expansion and/or a contraction of the priming chamber volume. The one-way valves 23*a*, 23*b* are arranged to permit gas and liquid flow only in the pumped direction, i.e. from the inlet 5 to the outlet 7. Thus, when the volume expands, gas or liquid is drawn into the priming chamber through valve 23*a* at the inlet of the priming chamber 11 and, when the volume contracts, gas or liquid is expelled from the priming chamber 11 through valve 23*b* at the exit of the priming chamber 11.

When the diaphragm 21 is driven with reciprocating motion by the drive means 25, a pumping effect is provided that is capable of drawing gas, as well as liquid, through the flow path of the pump 1. This pumping effect is sufficient to remove substantially all of the air from the flow path, thereby providing the priming function.

Once the pump 1 has been primed, the impeller 19 driven by the first shaft 15 of the motor 13 is able to provide the liquid pumping function. Thus, from this point in time, there is no need for the diaphragm 21 to continue to be driven by the drive means 25 with reciprocating motion. Moreover, such motion is inefficient and causes instability in the velocity of the pumped liquid. To avoid these problems, the drive means 25 includes a mechanism which disengages the drive from the diaphragm 21 immediately after priming of the pump is completed.

Figure 2:
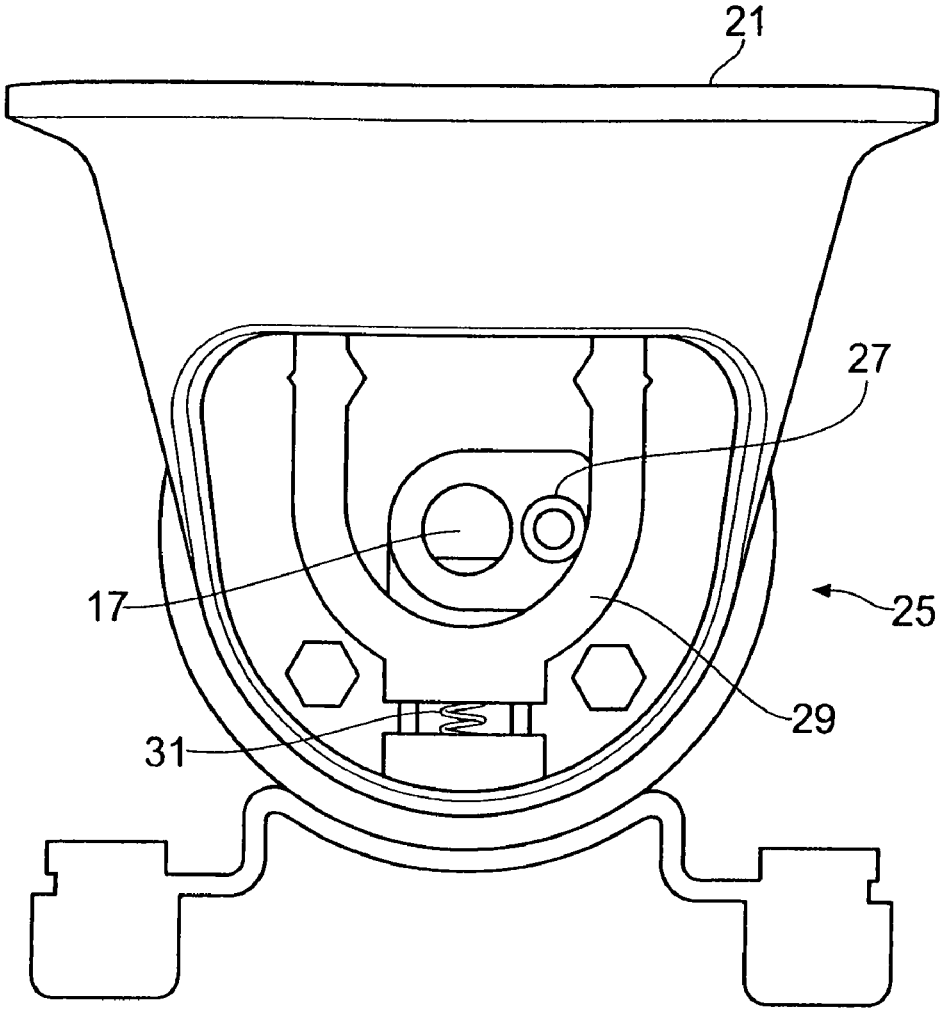
FIG. 2 is a view taken along the drive axis of FIG. 1, showing components of a first version of the self-priming centrifugal pump shown in FIG. 1.

FIG. 2 shows in detail a first version of the drive means 25 shown in FIG. 1. In FIG. 2, the second drive shaft 17 of the motor 13 is perpendicular to the plane of the drawing sheet. The drive means 25 is arranged so as to convert the rotational motion of the second drive shaft 17 into reciprocating motion for driving the diaphragm 21.

Specifically, the drive means 25 comprises a profiled cam 27 attached to the drive shaft 17 and a cam follower 29 positioned for reciprocating motion between the cam 27 and the diaphragm 21. The drive means also comprises a compression spring 31 arranged between the body 3 and the cam follower 29 for maintaining contact between the cam follower 29 and the diaphragm 21.

In use, the cam 27 rotates with the second drive shaft 17, to which it is attached by conventional means. During priming, the cam follower 29 is in sliding contact with the cam 27 for approximately half of each revolution of the cam 27, as shown in the Figure. The cam moves down the diaphragm, and the diaphragm moves up by itself and by the spring 31. Each revolution of the cam 27 causes the cam follower 27 to be displaced downwards and then upwards, and repeated rotation of the cam 27 provides the cam follower 29 with reciprocating motion. The cam follower 29 is attached to a central portion of the diaphragm 21, and transmits the reciprocating motion thereto, to thereby provide the priming function. The periphery of the diaphragm is stationary, and the middle of the diaphragm moves from a neutral position to a position further away from the middle of the downstream priming chamber as pressure in the priming chamber increases.

After the pump 1 has been primed, the pumping function is performed by the impeller 19, which causes a downstream pressure increase, including in the priming chamber 11. This increased pressure bears on the upper surface of the diaphragm 21 so that its neutral position is lowered. As a consequence of this lowering, the cam follower 29 is also lowered to such an extent that it no longer comes into contact with the rotating cam 27. Consequently, the motion of the cam follower 29 ceases and the drive is disengaged from the diaphragm 21.

By disengaging the drive in this way, the operation of the pump 1 is more efficient, since energy is not used to drive the diaphragm 21. The cam 27 continues to rotate, but this motion consumes a minimal amount of energy. Furthermore, the velocity of the pumped liquid remains stable, since the volume of the priming chamber 11 does not fluctuate.

FIGS. 3 to 6 show in detail a second version of the drive means 25 shown in FIG. 1. In FIGS. 3 to 7, the second drive shaft 17 of the motor 13 is again perpendicular to the plane of the drawing sheet. The drive means 25 is arranged so as to convert the rotational motion of the second drive shaft 17 into reciprocating motion for driving the diaphragm 21. The Figures show the drive means 25 at different stages of its operation.

The drive means 25 comprises a crank 33 attached at one end to the drive shaft 17 and an arcuate connecting arm 35 coupling the other end of the crank 33 to the diaphragm 21. The end of the connecting arm 35 that couples with the crank 33 is terminated in a cam follower in the form of a fork 35*a* arranged to loosely receive a cam, or protruding shaft 33*a* of the crank 33. A compression torsion spring 37 is also provided between the diaphragm 21 and a surface of the arm 35 so as to maintain the coupling between the crank 33 and connecting arm 35 during normal operation.

Figure 3:
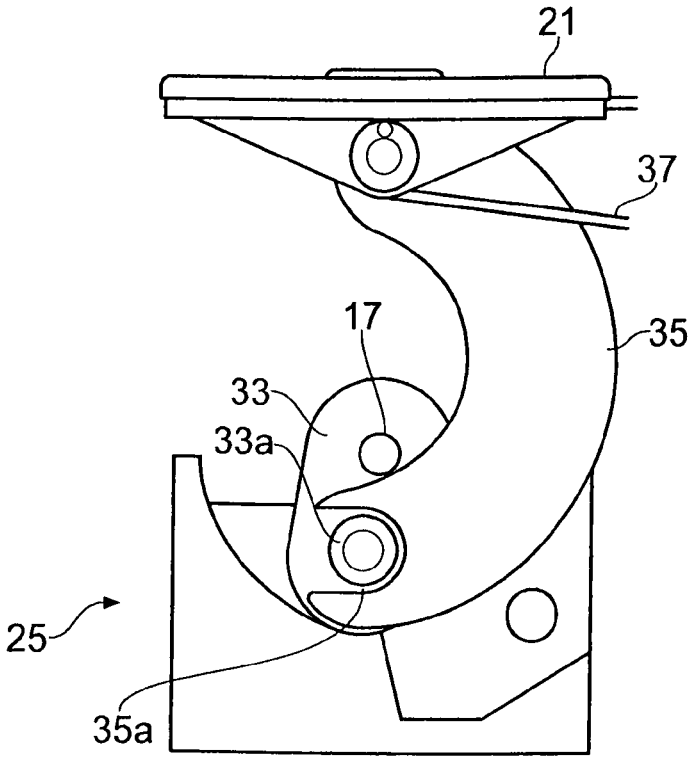
FIGS. 3 to 6 are views taken along the drive axis of FIG. 1, showing components of a second version of the self-priming centrifugal pump of FIG. 1 and their operation.

In use, during priming, the motion of the crank 33 and the connecting arm 35 is unrestricted, and they together drive the diaphragm 21 with reciprocating motion, as will be understood by those skilled in the art. This mode of operation is illustrated in FIG. 3.

Figure 4:
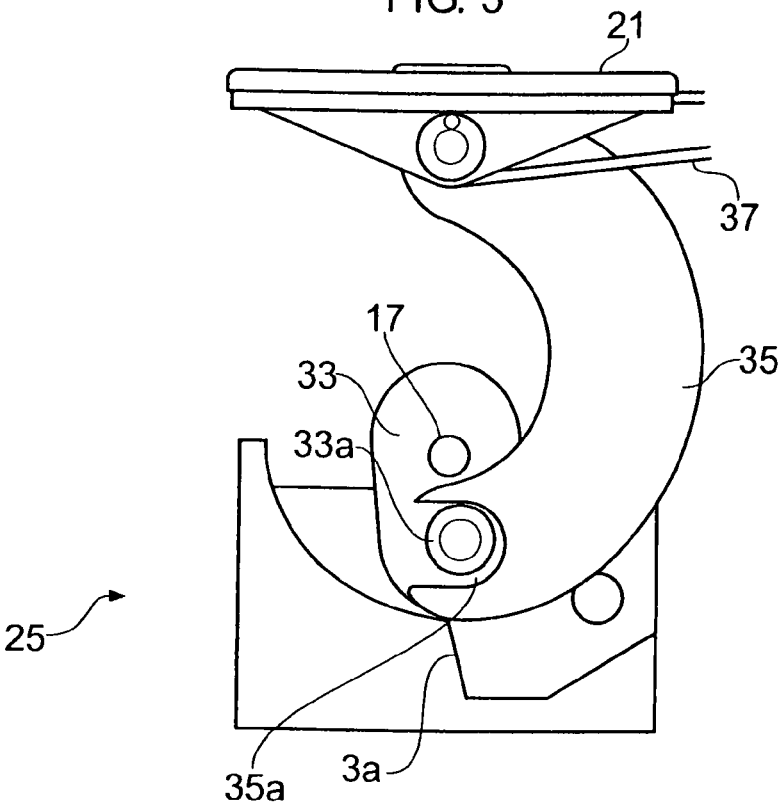

After the pump 1 has been primed, the pumping function of the impeller 19 causes a downstream increase in pressure, including an increase in pressure in the priming chamber 11. This increased pressure bears on the diaphragm 21 so that its neutral position is lowered. As a consequence of this lowering, the connecting arm 35 is also lowered to such an extent that its motion is prevented by a surface 3*a* of the pump body 3. This arrangement is illustrated in FIG. 4.

Figure 5:
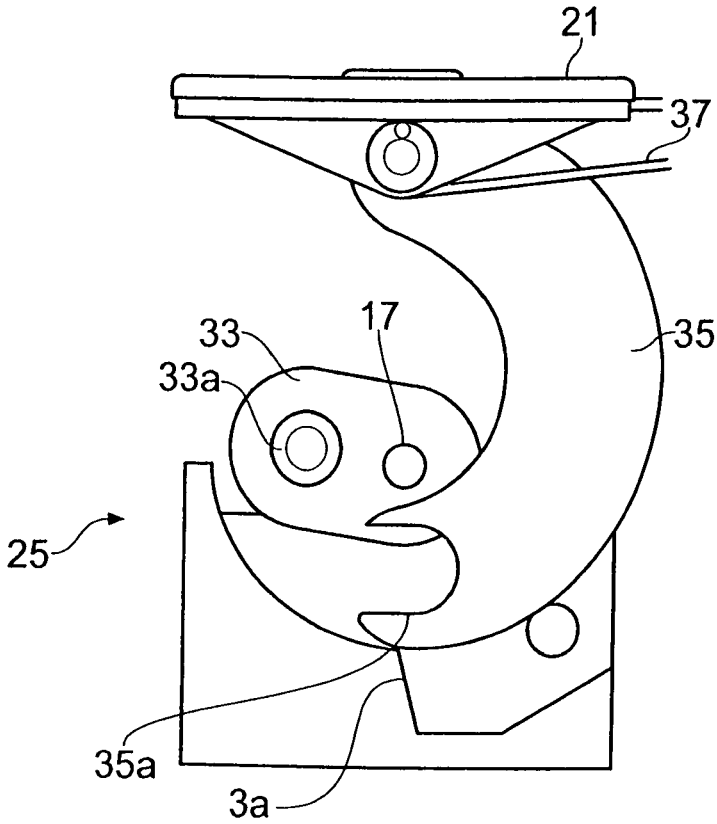
Figure 6:
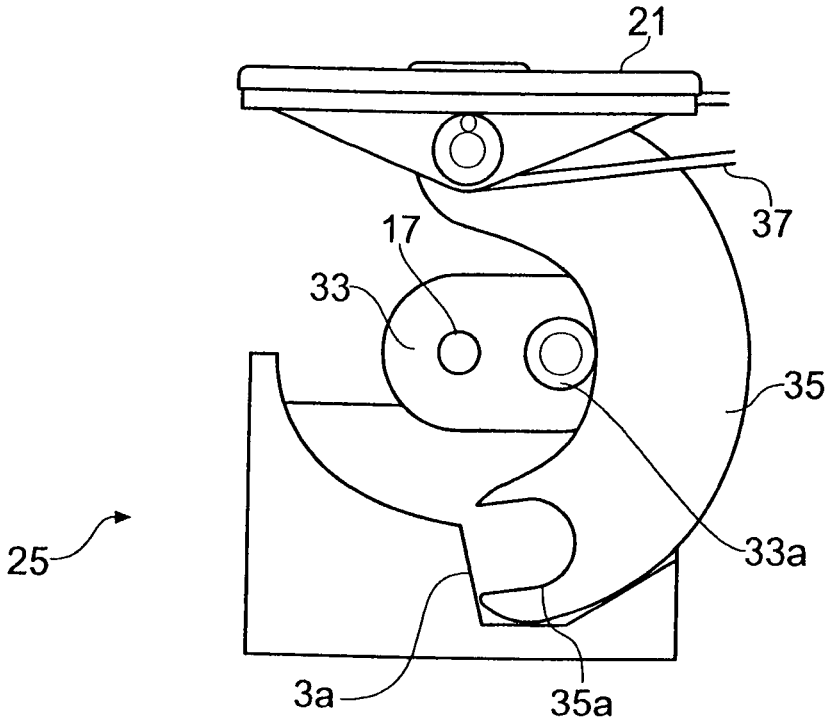

Subsequently, continued rotation of the crank 33 causes disengagement of the connecting arm 35, as shown in FIG. 5. A further revolution of the crank 33 pushes the connecting arm 35, against the tension spring 37, out of reach. Specifically, the forked end 35*a* of the connecting arm 35 moves downwards into engagement with the surface 3*a* of the pump body. This arrangement is illustrated in FIG. 6.

After the connecting arm 35 has become fully engaged with the surface 3*a* of the pump body 3, it no longer comes into contact with the crank 33. Consequently, the motion of the connecting arm 35 ceases and the drive is disengaged from the diaphragm 21.

As with the previously described version of the pump, by disengaging the drive in this way, the operation of the pump is more efficient, since energy is not used to drive the diaphragm 21. The crank 33 continues to rotate, but this motion consumes a minimal amount of energy. Furthermore, the velocity of the pumped liquid remains stable, since the volume of the priming chamber 11 does not fluctuate.

Figure 7:
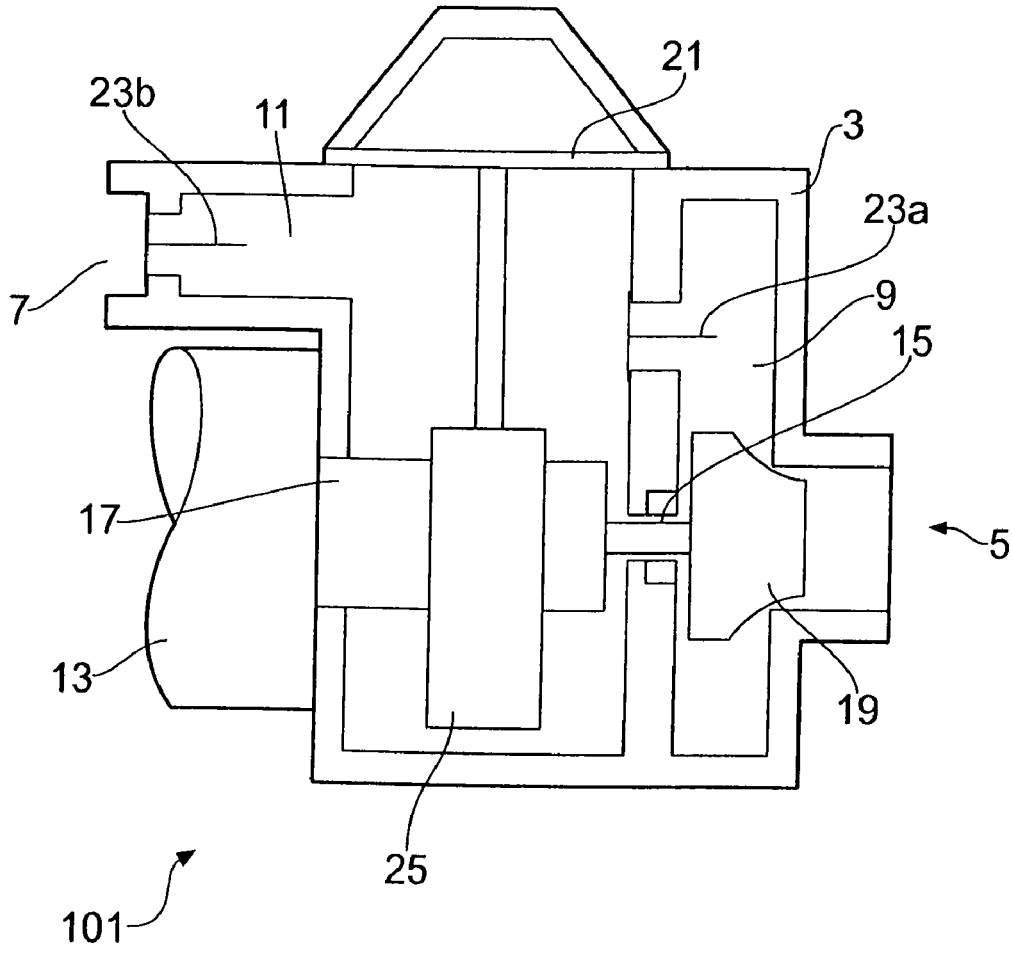
FIG. 7 is a schematic view of an alternative self priming centrifugal pump according to the invention.

FIG. 7 shows schematically a second embodiment of a pump 101 according to the invention. The pump 101 shown in FIG. 7 is similar to the pump 1 shown in FIG. 1, and like reference numerals are used to indicate components that are the same. The pump 101 differs from the pump 1 shown in FIG. 1 in that the drive means 25 is provided within the priming chamber 11, which chamber has a different shape. In all respects, the operation of the pump 101, including that of the drive means 25, is the same as that described above.

Preferred embodiments of the invention have been described above. However, it will be apparent to those skilled in the art that various changes and modifications may be made to these embodiments without departing from the scope of the invention, which is defined by the claims.

What is claimed is:

1. A self-priming centrifugal pump comprising:

a body that has chamber walls that form a cavity with an upstream pumping chamber that has an inlet and a downstream priming chamber that has an outlet;

a centrifugal impeller lying in said upstream chamber for pumping liquid from said inlet toward said outlet;

a diaphragm that is positioned along said downstream chamber and that is reciprocatable to repeatedly compress and expand said downstream chamber to prime the pump;

valve means coupled to said downstream chamber for allowing fluid flow only out of said outlet when the pump is being primed;

drive means including a mechanism for reciprocating the diaphragm during priming of the pump and for automatically not reciprocating the diaphragm in response to a pressure increase in the downstream chamber that indicates that the pump has been primed.

2. A pump according to claim 1, wherein:

said drive means includes an energizeable motor connected to said impeller to continually rotate said impeller and reciprocate said diaphragm, said motor being automatically disconnectable from at least a portion of said mechanism in response to said pressure increase in the downstream priming chamber.

3. A pump according to claim 1 wherein said mechanism includes a motor driven shaft, a cam connected to said shaft, and a cam follower coupled to said diaphragm to reciprocate it, wherein the cam and the cam follower are arranged to automatically lose contact when the diaphragm changes position as a result of a pressure increases in the downstream chamber.

4. A pump according to claim 1, wherein:

said mechanism comprises a crank and a connecting arm, the connecting arm being arranged to couple the crank to the diaphragm, wherein the crank and the connecting arm are arranged to automatically disengage when the pressure increase downstream of the impeller after priming causes a change in a neutral position of the diaphragm.

* * * * *